US006533643B1

(12) United States Patent
Feng

(10) Patent No.: US 6,533,643 B1
(45) Date of Patent: Mar. 18, 2003

(54) SANDBLASTING MASK DEVICES OF WOOD OBJECTS

(75) Inventor: Cheng-Hsing Feng, Taipei (TW)

(73) Assignee: North America Intellectual Property Corporation, Taipei Hsien (TW)

( * ) Notice: Subject to any disclaimer, the term of this patent is extended or adjusted under 35 U.S.C. 154(b) by 0 days.

(21) Appl. No.: 09/683,575

(22) Filed: Jan. 22, 2002

(51) Int. Cl.[7] ..... B24B 1/00

(52) U.S. Cl. ..... 451/29; 451/30; 451/31; 451/38; 451/75; 451/80; 451/81

(58) Field of Search ..... 451/29, 30, 31, 451/38, 75, 80, 81

(56) References Cited

U.S. PATENT DOCUMENTS 4,133,919 A * 1/1979 Parsons ..... 427/259
4,828,893 A * 5/1989 Tallman ..... 428/40
5,197,234 A * 3/1993 Gillenwater ..... 451/29
5,512,005 A * 4/1996 Gulling ..... 451/29

* cited by examiner

*Primary Examiner*—Joseph J. Hail, III
*Assistant Examiner*—Shantese McDonald
(74) *Attorney, Agent, or Firm*—Winston Hsu

(57) ABSTRACT

A sandblasting mask device for performing sandblasting processes on wood objects is disclosed. The mask device includes a base and a mask cover. The base has a fixture for fixing a wood object that has a target surface to be worked on. The mask cover is removably fixed on the base. The mask cover includes a mask panel, which contains at least one sandblasting opening of a predetermined shape. When the mask cover is fixed on the base, the wood object is tightly clamped between the mask cover and the base, and the mask panel of the mask cover is closely attached to the target surface of the object. The sandblasting opening of the mask panel will expose a predetermined portion of the target surface of the object for performing the sandblasting process.

21 Claims, 10 Drawing Sheets

SANDBLASTING MASK DEVICES OF WOOD OBJECTS

BACKGROUND OF THE INVENTION

1. Field of the Invention

The present invention relates to a sandblasting mask device. More specifically, the present invention discloses a sandblasting mask device for performing a sandblasting process to a target surface of wooden furniture.

2. Description of the Prior Art

Many traditional wooden products such as tables, chairs, and wardrobes are manufactured by machining. In addition, some wooden products such as Buddhist statues and picture frames are formed by handiwork. For those wooden products that have extra requirements for look and feel, many wooden products are replaced instead by metalwork.

For those wooden products that need extra precision, the main manufacturing concern is the extra time needed during the manufacturing process. As with all manufacturing, the more time and complexity involved in producing a product, the more costly it is to manufacture. Therefore, the costs of precision wood products are relatively high. This problem is one that the manufacturers of wooden products are eager to solve.

When making wooden picture frames, patterns depicted on the picture frames are used to complement pictures that will be placed in the picture frames. Under the conditions of precise and exquisite handiwork, the manufacturer must spend more time and effort on manufacturing. Generally, the manufacturers of picture frames fabricate a paper or plastic mask device according to the desired patterns to be formed on the picture frame. Then, by sticking the paper or plastic mask device onto the picture frame, a carver is capable of using an engraver to carve the desired figures on the picture frame according to the patterns on the mask device. Next, a surface processing procedure such as smoothing the surface with sandpaper is performed on the picture frame. Finally, a protective layer is smeared over the surface of the picture frame so as to prevent the picture frame from deteriorating or being scratched.

The above-mentioned processing procedure for picture frames is a well-known disclosure. When the manufacturer of the picture frame receives a large amount of orders, the prior art solution requires filling these orders by working nearly day and night. These overtime working hours further lead to an increase in manufacturing costs.

SUMMARY OF THE INVENTION

It is therefore a primary objective of the claimed invention to provide a sandblasting mask device for performing a sandblasting process on a target surface of wooden furniture so as to increase efficiency of production and reduce costs of manufacturing.

The claimed invention discloses sandblasting mask devices for performing, sandblasting processes on wood objects. The mask device includes a base and a mask cover. The base has a fixture for fixing a wood object to be worked on. The removable mask cover is fixed on the base. The mask cover includes a mask panel, which contains at least one sandblasting opening of a predetermined shape. When the mask cover is fixed on the base, the wood object is tightly clamped between the mask cover and the base, and the mask panel of the mask cover is closely attached to a target surface of the object. The sandblasting opening of the mask panel will expose a predetermined portion of the target surface of the object so as to perform the sandblasting process.

It is an advantage of the claimed invention that the sandblasting mask device has reusability. Therefore, the manufacturer only needs to fabricate the mask panels having the desired patterns on the picture frames. The sandblasting process can then be performed via a computer and a sandblasting machine so as to enhance productivity and reduce manufacturing costs.

These and other objectives and advantages of the present invention will no doubt become obvious to those of ordinary skill in the art after reading the following detailed description of the preferred embodiment that is illustrated in the various figures and drawings.

BRIEF DESCRIPTION OF DRAWINGS

FIG. 2 is a diagram of the sandblasting mask device depicted in FIG. 1 connecting with an object that has a target surface to be worked on.

DETAILED DESCRIPTION

Figure 1:
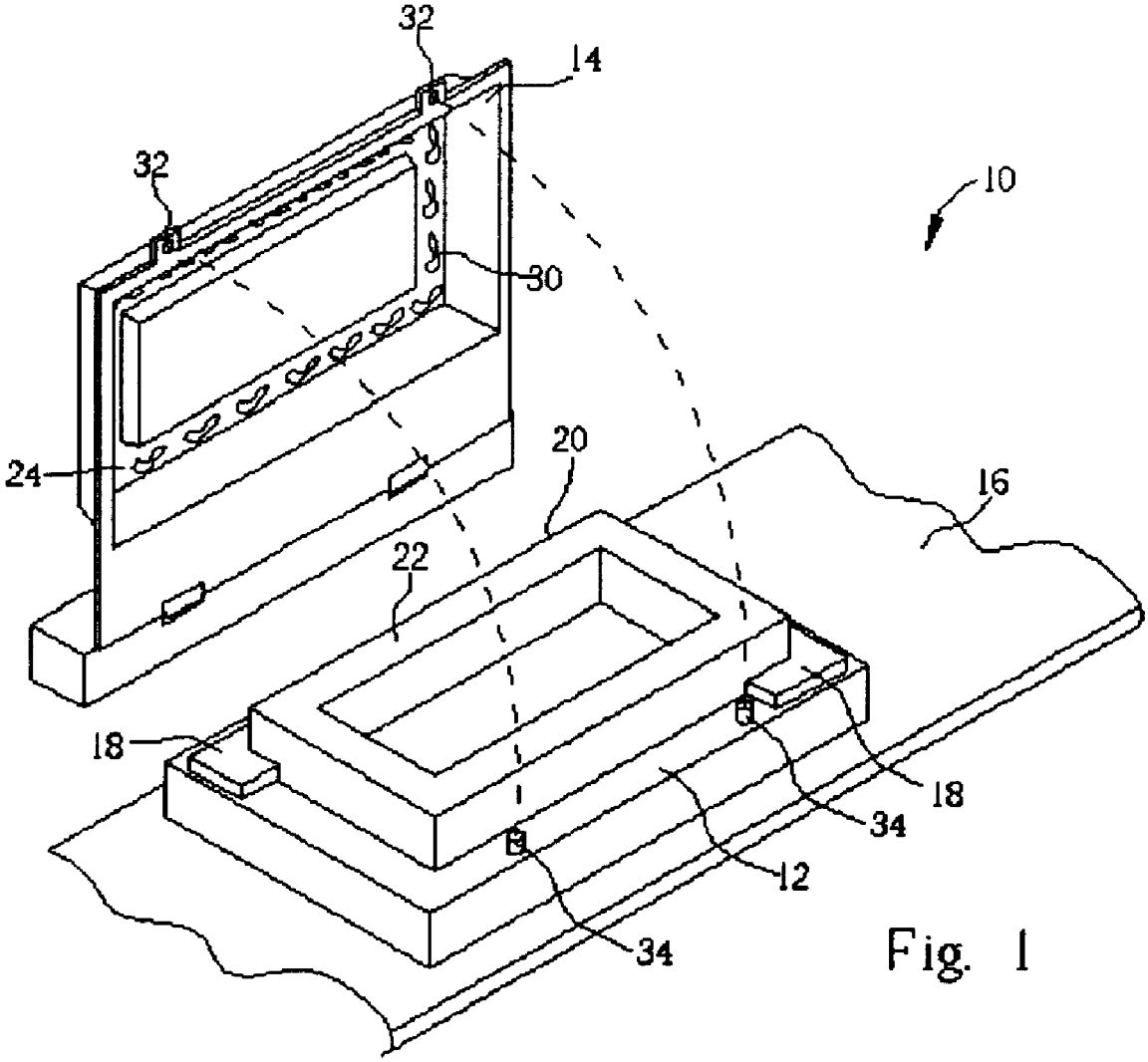
FIG. 1 is a diagram of a sandblasting mask device with a peripheral device according to the present invention.
Figure 2:
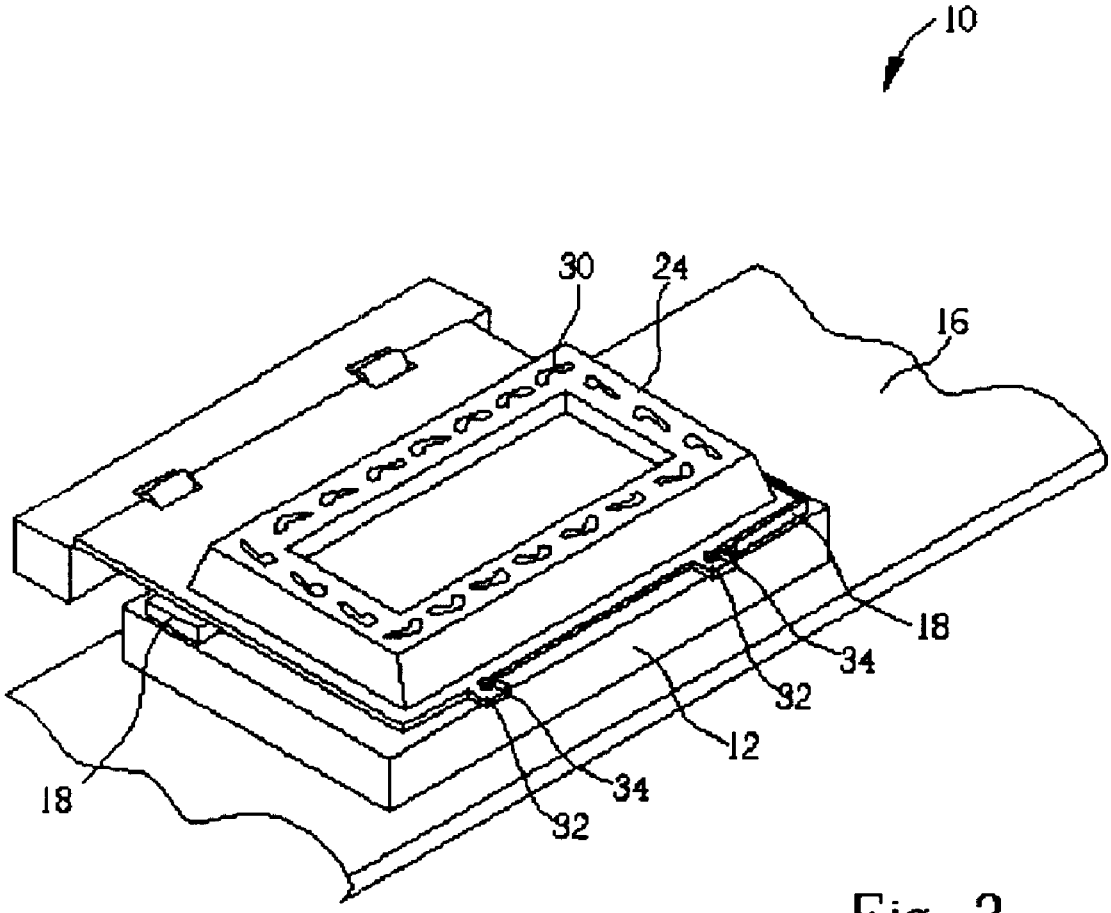

Please refer to FIGS. 1 and 2. FIG. 1 is a diagram of a sandblasting mask device 10 with a conveyor belt 16 peripheral device according to the present invention. FIG. 2 is a diagram of the sandblasting mask device 10 depicted in FIG. 1 connecting with an object 20, which has a target surface 22 to be worked on. The object 20 is a picture frame made of wood. As shown in FIG. 1, the sandblasting mask device 10 comprises a base 12 and a mask cover 14. The base 12 positioned on the conveyor belt 16 comprises a fixture 18 for fixing the object 20 of a predetermined shape, which has the target surface 22 to be worked on. The mask cover 14, which is removable, can be fixed on the base 12. The mask cover 14 comprises a mask panel 24, which contains at least one sandblasting opening 30 of a predetermined shape. The fixture 18 has a slot for receiving a lower portion of the object 20. The fixture 18 fastens the mask cover 14 on the base 12 and functions as a clamping device for clamping the object 20 so as to fix the object 20 on the base 12. The conveyor belt 16 can move the object 20 to different mask covers 14 for performing various sandblasting processes. Furthermore, the sandblasting mask device 10 further comprises a lock 32 and a bolt 34. The lock 32 is used to connect with the bolt 34 so that the object 20 can be tightly clamped between the mask cover 14 and the base 12.

As shown in FIG. 2, when the mask cover 14 is fixed on the base 12 via the lock 32 and the bolt 34, the mask panel 24 of the mask cover 14 is closely attached to the target surface 22 of the object 20 so that the object 20 is clamped between the mask panel 24 and the fixture 18. The sandblasting opening 30 of the mask panel 24 exposes a predetermined portion of the target surface 22 of the object 20 for performing the sandblasting process.

Figure 3:
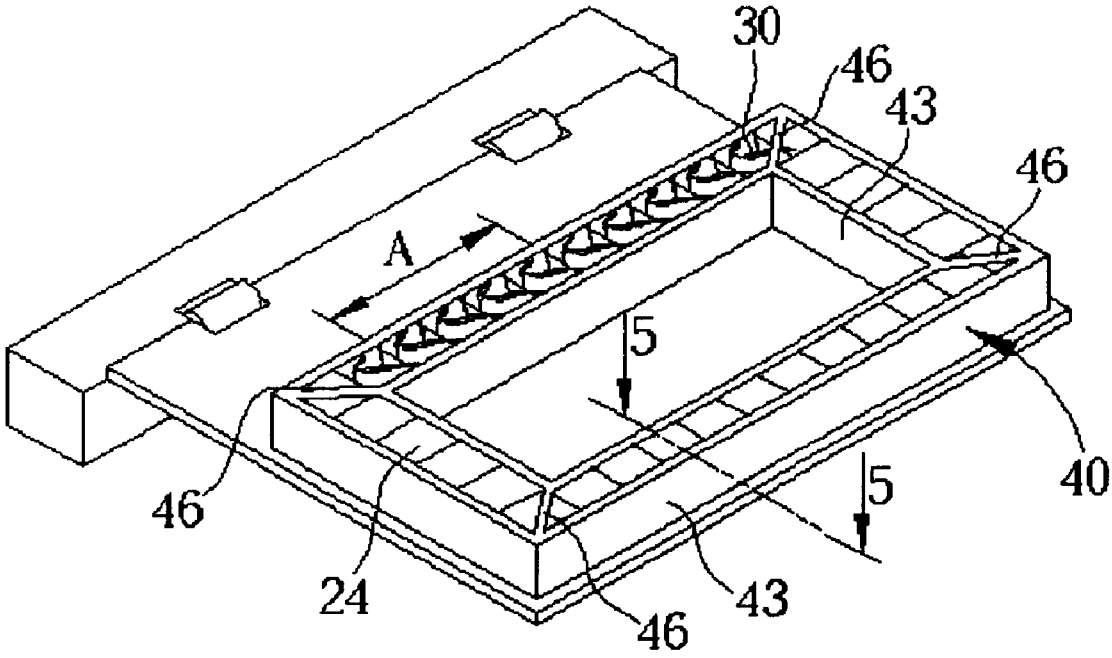
FIG. 3 is a perspective view of the present invention sandblasting mask device which utilizes a plurality of sandblasting mask panels to perform a sandblasting process.
Figure 4:
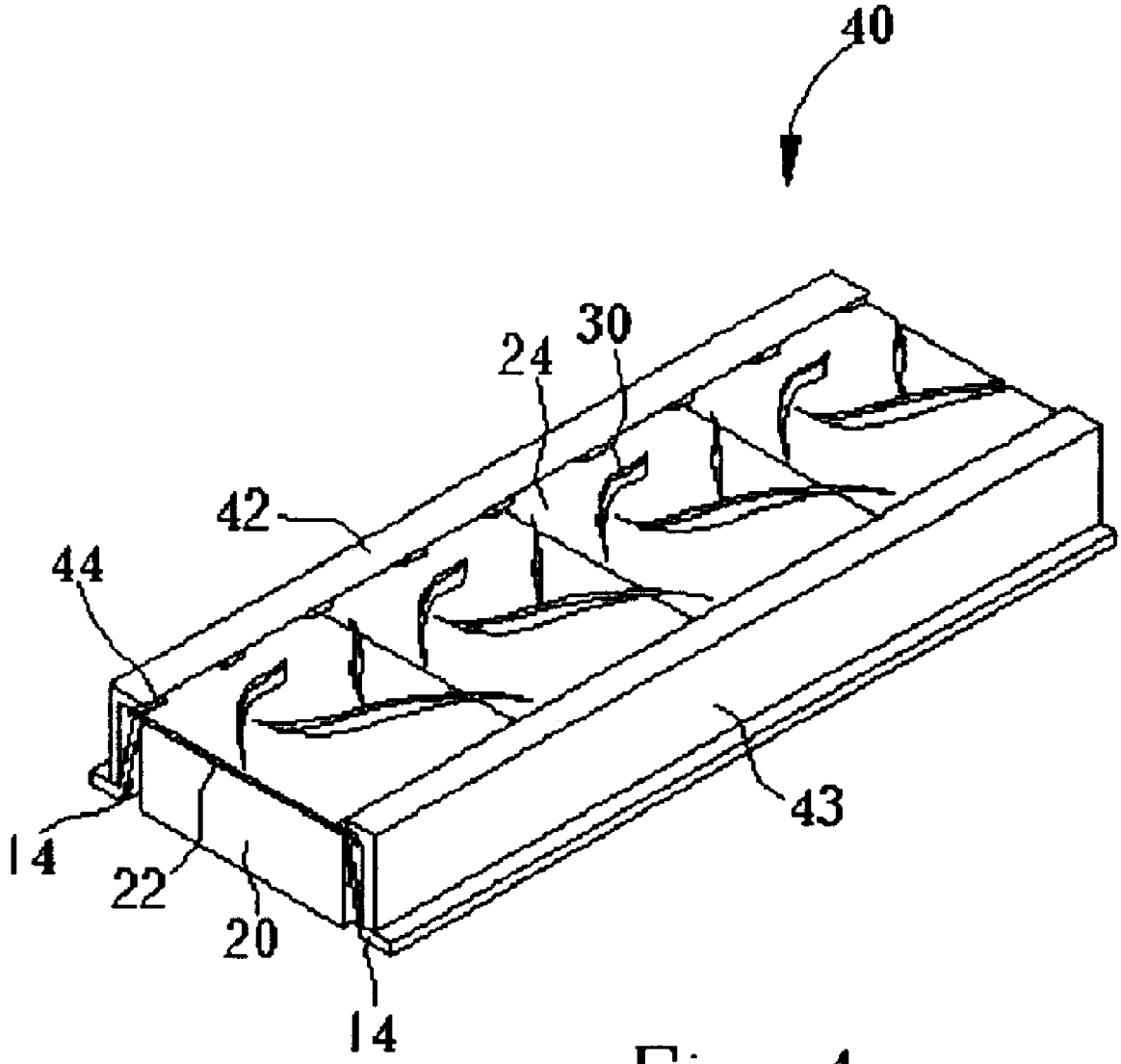
FIG. 4 is an amplified diagram of a segment of the sandblasting mask device depicted in FIG. 3.
Figure 5:
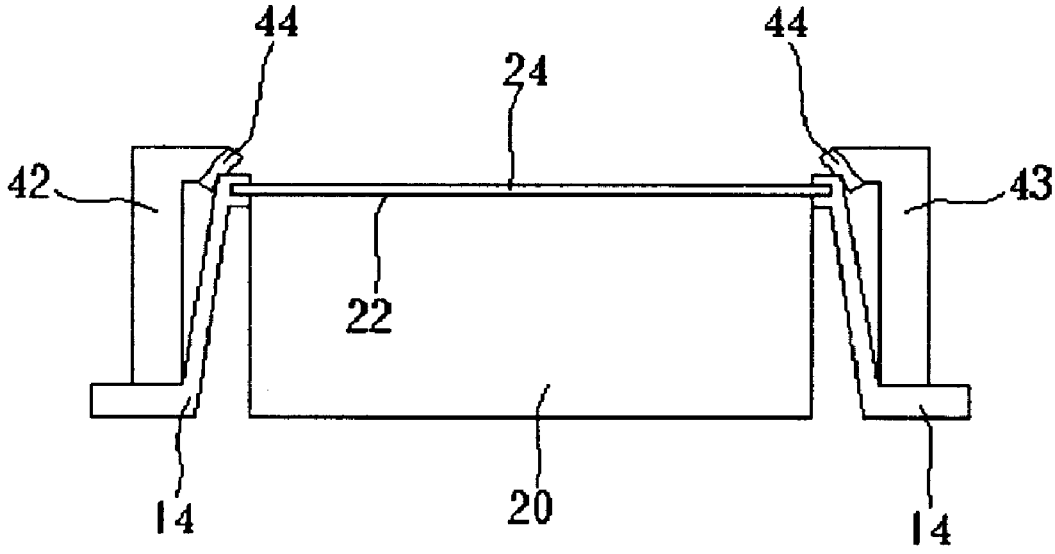
FIG. 5 is a cross-sectional view of the sandblasting mask device depicted in FIG. 3.

Please refer to FIGS. 3, 4, and 5. FIG. 3 is a perspective view of the present invention sandblasting mask device 10, which utilizes a plurality of sandblasting mask panels 24 to perform the sandblasting process. FIG. 4 is an enlarged diagram of an A segment of the sandblasting mask device 10 depicted in FIG. 3. FIG. 5 is a cross-sectional view the sandblasting mask device 10 depicted in FIG. 3 along a tangent 5—5. As shown in FIGS. 3, 4, and 5, the mask panel 24 of the sandblasting mask device 10 is made of a resilient metallic plate, which comprises a supporting structure 40 installed on the mask panel 24. The supporting structure 40 comprises two racks 42, 43 and four connecting arms 46 monolithically formed or welded with the racks 42 and 43. The racks 42 and 43 have a plurality of elastic elements 44 made of plastic material, which contacts areas nearby the sandblasting opening 30 of the mask panel 24. The mask panel 24 is dismountably fixed beneath the racks 42 and 43. When the mask cover 14 is fixed beneath the racks 42 and 43, the elastic elements 44 will elastically push the mask panel 24 towards the target surface 22 of the object 20 so as to closely attach the sandblasting opening 30 of the mask panel 24 onto the target surface 22 of the object 20. Additionally, the mask panel 24 is permitted to have a plurality of predetermined sandblasting openings 30. The amounts and shapes of the sandblasting openings 30 are determined according the desired patterns to be formed on the target surface 22 of the object 20. If one mask panel 24 cannot form the desired patterns on the target surface 22 of the object 20, a manufacturer can utilize a plurality of mask panels 24 having the openings 30 of different shapes to perform the sandblasting process. Furthermore, if one sandblasting mask device 10 cannot manufacture the desired patterns on the target surface 22 of the object 20, the manufacturer can utilize the plurality of mask panels 24 to gradually form the target surface 22 of the object 20 with a specific pattern or shape. This is accomplished by using a conveyor belt 1 6 to move the base 12, which supports the object 20, to different mask panels 24.

Figure 6:
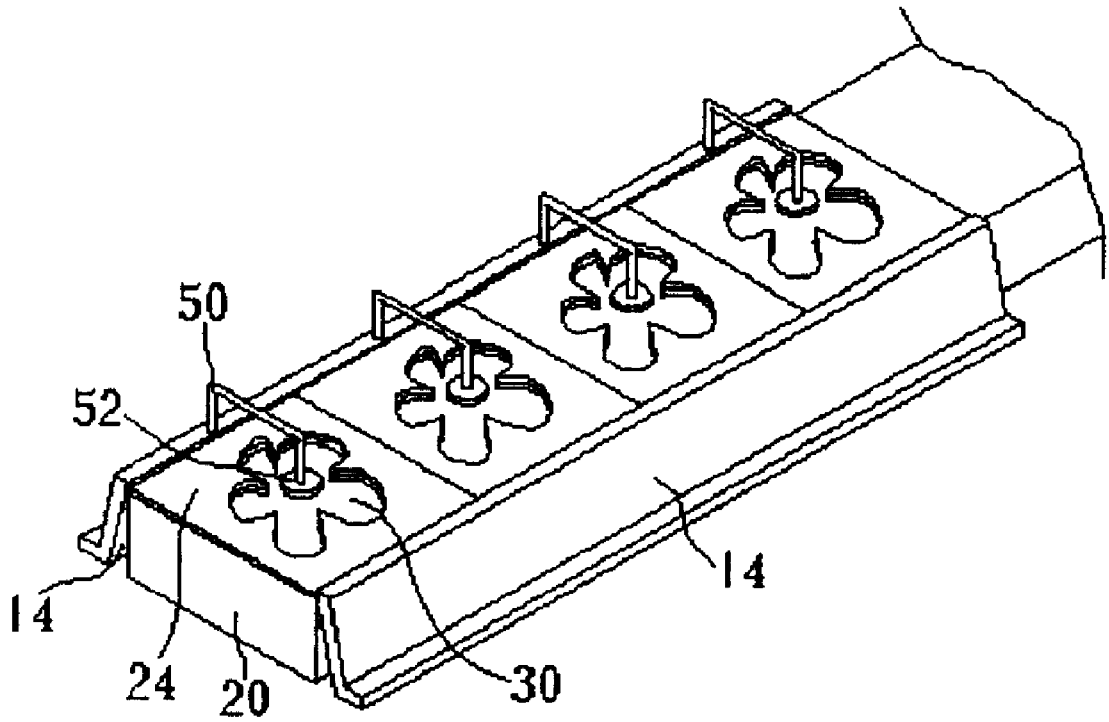
FIG. 6 is a diagram of the sandblasting mask panel of the sandblasting mask device with desired patterns of the target surface of the object.
Figure 7:
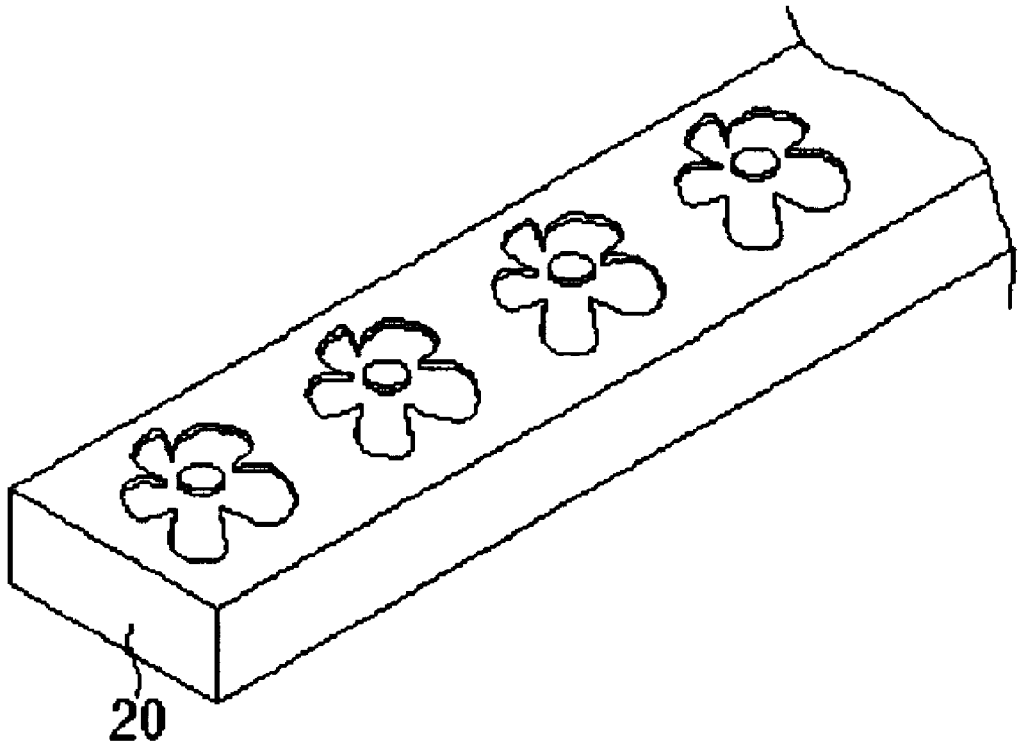
FIG. 7 is a diagram of the patterns formed on the target surface of the object after performing the sandblasting process depicted in FIG. 6.

Please refer to FIG. 6 and FIG. 7. FIG. 6 is a diagram of the sandblasting mask panel 24 of the sandblasting mask device 10 with desired patterns of the target surface 22 of the object 20. FIG. 7 is a diagram of the patterns formed on the target surface 22 of the object 20 after performing the sandblasting process depicted in FIG. 6. As shown in FIG. 6 and FIG. 7, when the mask panel 24 cannot manufacture the desired patterns to be formed on the target surface 22 of the object 20, such as a protruded island-shaped pattern, the sandblasting mask device 10 further comprises at least one suspension arm 50 and a mask piece 52 positioned within the opening 30 of the mask panel 24. The suspension arm 50 is used to fix the mask piece 52 on the mask cover 14. When the mask cover 14 is fixed on the base 12, the mask piece 52 will attach to the object 20 closely at a specific positioning in the sandblasting opening 30. Therefore, the manufacturer can manufacture the desired patterns on the object 20 by performing the sandblasting process.

Figure 8:
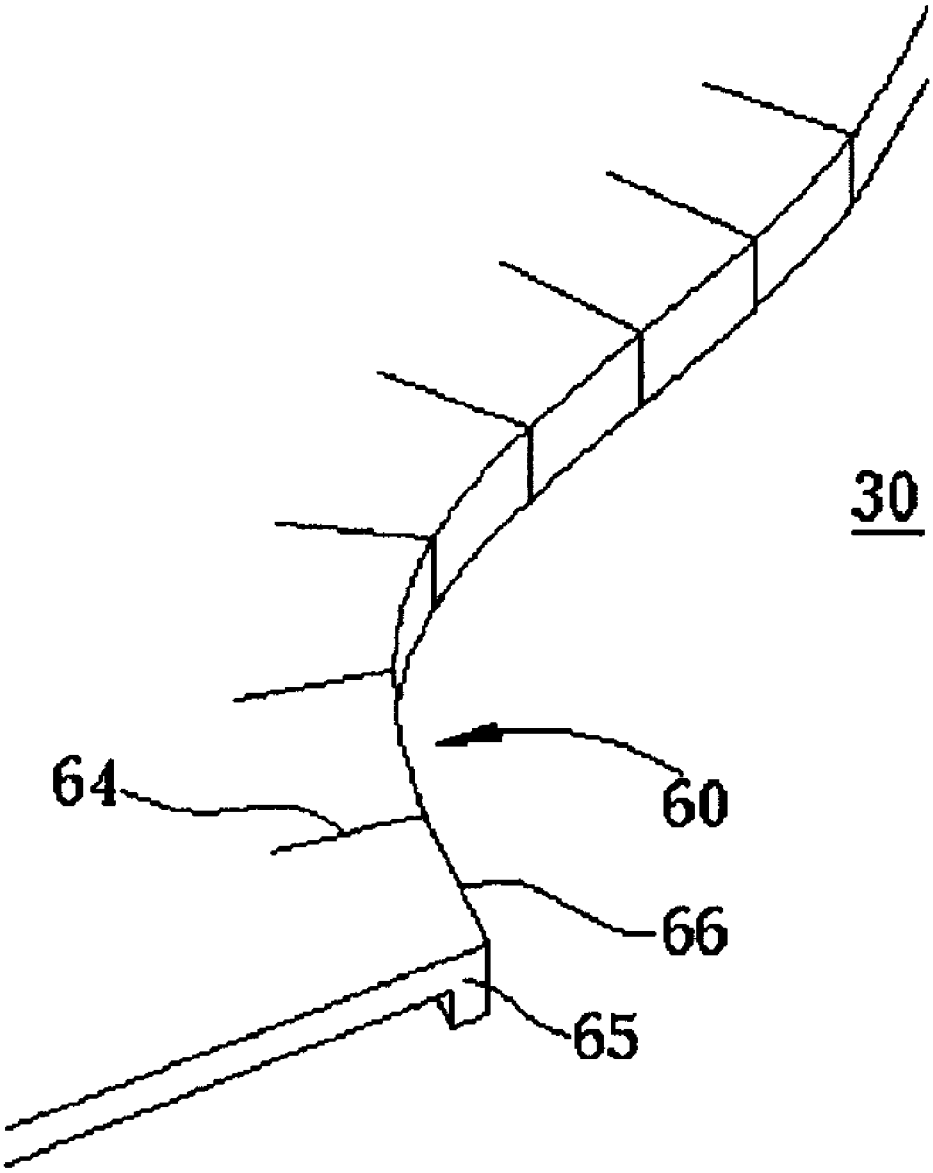
FIG. 8 is a diagram of a first preferred embodiment of sandblasting openings positioned on the mask panel of the present invention sandblasting mask device.
Figure 9:
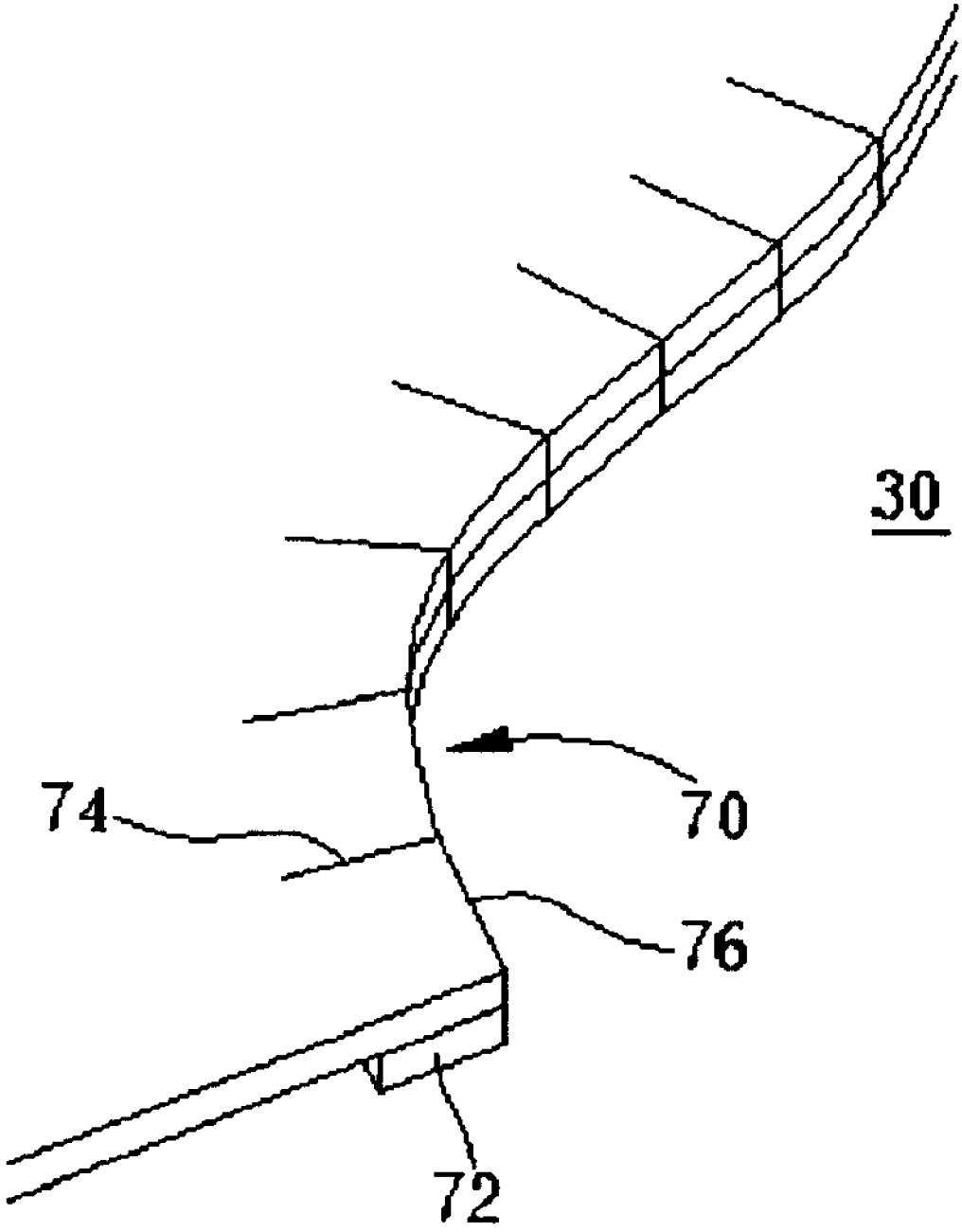
FIG. 9 is a diagram of a second preferred embodiment of sandblasting openings positioned on the mask panel of the present invention sandblasting mask device.
Figure 10:
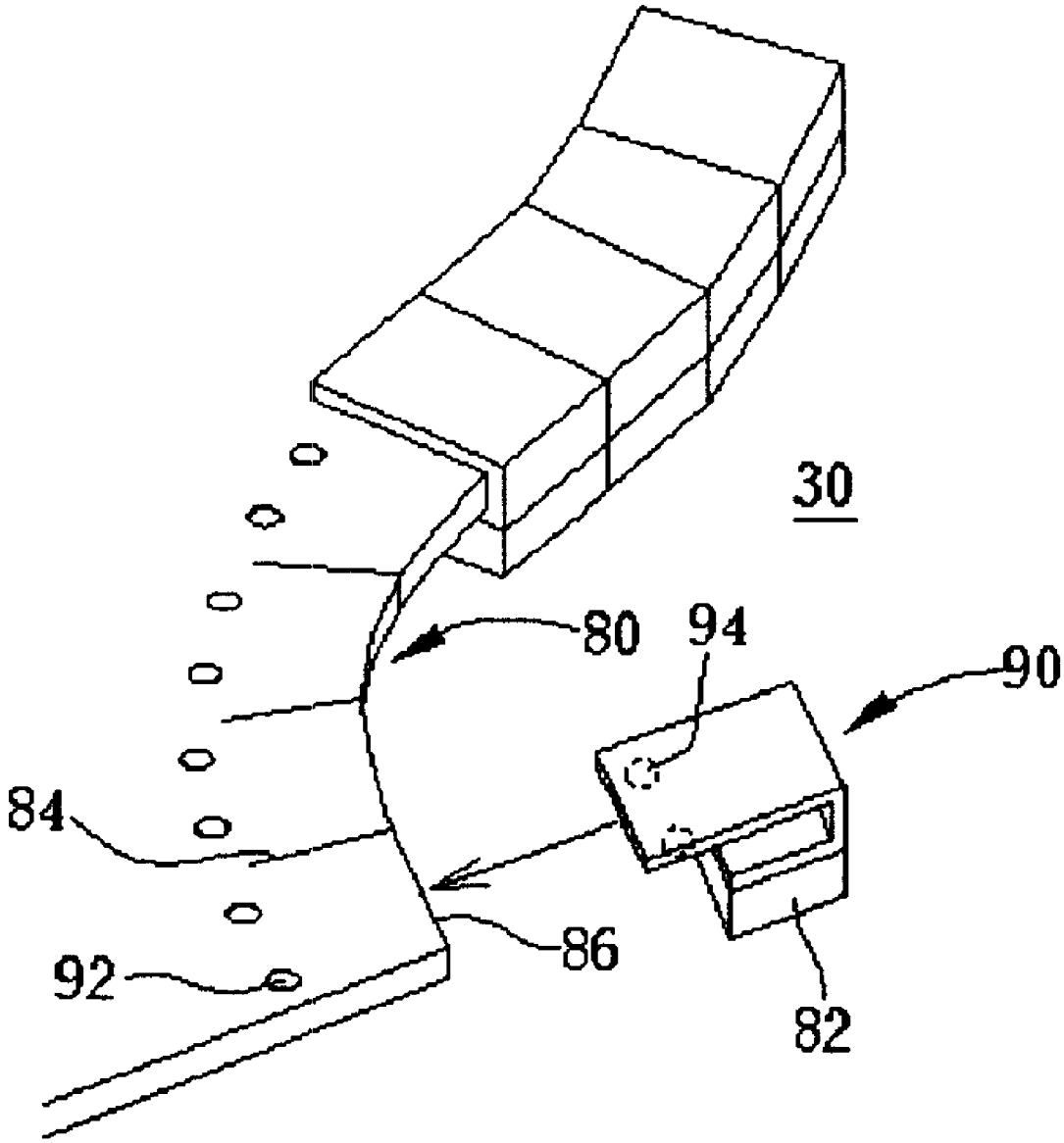
FIG. 10 is a diagram of a third preferred embodiment of sandblasting openings positioned on the mask panel of the present invention sandblasting mask device.

Please refer to FIGS. 8, 9, and 10. FIG. 8 is a diagram of a first preferred embodiment of sandblasting openings 30 positioned on the mask panel 24 of the present invention sandblasting mask device 10. FIG. 9 is a diagram of a second preferred embodiment of sandblasting openings 30 positioned on the mask panel 24 of the present invention sandblasting mask. device 10. FIG. 10 is a diagram of a third preferred embodiment of sandblasting openings 30 positioned on the mask panel 24 of the present invention sandblasting mask device 10. As shown in FIG. 8, in the first preferred embodiment of the sandblasting mask device 10, the mask panel 24 has a downward L-shape protruded edge 65 formed around the sandblasting opening 30. In addition, an edge 60 of the sandblasting opening 30 has a plurality of cuts 64 around the sandblasting opening 30 for cutting the edge of the mask panel 24 around the sandblasting opening 30 into a plurality of short sides 66. The L-shape protruded edge 65, monolithically formed with the short sides 66, is a metallic piece. When the mask cover 14 is fixed on the base 12, the L-shape protruded edge 65 around the sandblasting opening 30 will closely contact the target surface 22 of the object 20 so as to remove a gap between the edge 65 of the mask panel 24 around the sandblasting opening 30 and the target surface 22 of the object 20. Therefore, the manufacture obtains the ideal patterns desired on the target surface 22 of the object 20 when performing the sandblasting process, according to the original shape of the opening 30.

As shown in FIG. 9, in the second preferred embodiment of the sandblasting mask device 10, the mask panel 24 also has a downward L-shape protruded edge formed around the sandblasting opening 30. An edge 70 of the sandblasting opening 30 has a plurality of cuts 74 around the sandblasting opening 30 for cutting the edge of the mask panel 24 around the sandblasting opening 30 into a plurality of short sides 76. Additionally, an elastic protruded edge 72 is formed below each of the short sides 76 and closely contacts each of the short sides 76. The elastic protruded edge 72 is formed by a thin layer which is made of a rubber pad or a sponge pad and is resistant to sandblasting. When the mask cover 14 is fixed on the base 12, the elastic protruded edge 72 around the sandblasting opening 30 will elastically contact the target surface 22 of the object 20 so as to remove a gap between the edge 70 of the mask panel 24 around the sandblasting opening 30 and the target surface 22 of the object 20. Therefore, the manufacture obtains the ideal patterns desired on the target surface 22 of the object 20 after performing the sandblasting process.

As shown in FIG. 10, in the third preferred embodiment of the sandblasting mask device 10, an elastic protruded edge 82 is formed by enclosing each short side 86 with a sheath 90. In addition, the elastic protruded edge 82 can also be an L-shape metallic piece monolithically formed with the sheath 90 or an elastic thin layer that is resistant to sandblasting. A bolt 94 is dismountably installed on the sheath 90 and can be tightly plugged into a hole 92 on an edge 80 of the sandblasting opening 30. After performing the sandblasting process on the object 20, the manufacture can dismount the sheath 90 on each short side 86 for reuse in other sandblasting. processes. This reusability reduces the costs of manufacturing and production of the object 20.

The present invention sandblasting process utilizes an automatic sandblasting machine and a computer to function as a manufacturing instrument. However, the sandblasting machine and the control device are well known in industry, and does not require a detailed disclosure.

In contrast to the prior art, the present invention sandblasting mask device has reusability. Therefore, the manufacturer only needs to fabricate the mask panels having desired patterns of the picture frames. The sandblasting process is then performed via a computer and a sandblasting machine so as to enhance productivity and reduce manufacturing costs.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A sandblasting mask device comprising:

a base including a fixture for fixing an object which has a target surface to be worked on;

a mask cover removably fixed on the base including a mask panel which contains at least one sandblasting opening of a predetermined shape;

wherein when the mask cover is fixed on the base, the mask panel of the mask cover is closely attached to the target surface of the object, the sandblasting opening of the mask panel exposing a predetermined portion of the target surface of the object so as to perform a sandblasting process.

2. The mask device of claim 1 wherein the mask panel is made of a metallic plate.

3. The mask device of claim 2 wherein the metallic plate is resilient.

4. The mask device of claim 1 wherein the mask panel contains a plurality of sandblasting openings each of a predetermined shape; the mask device further comprises a supporting structure installed on the mask panel contacting areas nearby the sandblasting openings; and when fixing the mask cover on the base, the supporting structure pushes the mask panel towards the target surface of the object so as to closely attach the plurality of sandblasting openings of the mask panel onto the target surface of the object.

5. The mask device of claim 4 wherein the supporting structure comprises at least one rack and a plurality of elastic elements installed on the rack and contacting areas nearby the sandblasting openings for elastically pushing the mask panel towards the target surface of the object so as to closely attach the plurality of sandblasting openings of the mask panel onto the target surface of the object.

6. The mask device of claim 1 further comprising a supporting structure installed on the mask panel and contacting areas nearby the sandblasting openings, wherein when fixing the mask cover on the base, the supporting structure pushes the mask panel towards the target surface of the object so as to closely attach the sandblasting opening of the mask panel onto the target surface of the object.

7. The mask device of claim 6 wherein the supporting structure comprises at least one rack and a plurality of elastic elements installed on the rack and contacting areas nearby the sandblasting opening for elastically pushing the mask panel towards the target surface of the object so as to closely attach the sandblasting opening of the mask panel onto the target surface of the object.

8. The mask device of claim 1 wherein the mask panel has a downward elastic protruded edge formed around the sandblasting opening; and when fixing the mask cover on the base, the protruded edge around the sandblasting opening will elastically contact the target surface of the object so as to remove a gap between an edge of the mask panel around the sandblasting opening and the target surface of the object.

9. The mask device of claim 8 wherein the mask panel has a plurality of cuts around the sandblasting opening for cutting the edge of the mask panel around the sandblasting opening into a plurality of short sides, the protruded edge being formed below each of the short sides.

10. The mask device of claim 9 wherein the protruded edge is formed by a thin layer which is resistant to sandblasting.

11. The mask device of claim 10 wherein the thin layer is a rubber pad or a sponge pad.

12. The mask device of claim 9 wherein the protruded edge is of an L-shape.

13. The mask device of claim 12 wherein the L-shaped protruded edge is a metallic piece or is formed monolithically.

14. The mask device of claim 9 wherein the protruded edge is formed by enclosing each short side with a sheath.

15. The mask device of claim 1 further comprising a rack dismountably installed on the base.

16. The mask device of claim 1 wherein the fixture has a slot for receiving a lower portion of the object; and when fixing the mask cover on the base, the object is clamped between the mask panel and the fixture.

17. The mask device of claim 1 wherein the fixture is a clamping device for clamping the object so as to fix the object on the base.

18. The mask device of claim 1 wherein the base is positioned on a conveyor belt which is capable of moving the object to different mask covers for performing sandblasting processes.

19. The mask device of claim 1 wherein the mask panel comprises a mask piece and at least one suspension arm fixed on the mask piece for fixing the mask piece on the object; and when fixing the mask cover on the base, the mask piece will attach to the object closely at a specific position in the sandblasting opening.

20. The mask device of claim 1 wherein the object is made of wood.

21. The mask device of claim 20 wherein the object is a wood frame.

* * * * *